US005419963A

United States Patent [19]

Kuebler

[11] Patent Number: 5,419,963

[45] Date of Patent: May 30, 1995

[54] STRING HAVING DIFFERENT MODULUS OF ELASTICITY FOR STRINGING A RACKET FOR BALL GAMES

[76] Inventor: Siegfried Kuebler, Mozartstr. 17, D-88662 Uberlingen, Germany

[21] Appl. No.: 163,831

[22] Filed: Dec. 7, 1993

[30] Foreign Application Priority Data

Dec. 17, 1992 [DE] Germany ..... 42 42 673.1

[51] Int. Cl.[6] ..... D02G 3/00

[52] U.S. Cl. ..... 428/364; 428/373; 428/394; 428/395; 57/243; 273/67 R; 273/73 A; 273/73 R; 84/297 S

[58] Field of Search ..... 428/364, 373, 394, 395; 57/243; 273/73 A, 67 R; 84/297 S

[56] References Cited

U.S. PATENT DOCUMENTS

| | | | |
|---|---|---|---|
| 2,425,831 | 8/1947 | Rozanek | 425/123 |
| 3,979,110 | 9/1976 | Newton | 267/152 |
| 4,168,603 | 9/1979 | Reich et al. | 57/260 |
| 4,339,499 | 7/1982 | Tappe et al. | 428/373 |
| 4,382,358 | 5/1983 | Tappe et al. | 57/243 |
| 4,415,391 | 11/1983 | Reid | 267/153 |
| 4,436,305 | 3/1984 | Fernandez | 273/73 |
| 4,568,415 | 2/1986 | Woldtron | 156/185 |
| 4,835,036 | 5/1989 | Woltron et al. | 428/192 |
| 4,974,865 | 12/1990 | Umlauft et al. | 273/73 |

*Primary Examiner*—Patrick J. Ryan
*Assistant Examiner*—Merrick Dixon
*Attorney, Agent, or Firm*—Bachman & LaPointe

[57] ABSTRACT

The modulus of elasticity of a string portion or a string of uniform diameter for stringing a racket for ball games, in particular a tennis racket, differs in a section-wise manner. This may be by a stepwise change of the said modulus of elasticity along the length of the string or a stepless variation of the said modulus of elasticity along the length of the string.

9 Claims, No Drawings

STRING HAVING DIFFERENT MODULUS OF ELASTICITY FOR STRINGING A RACKET FOR BALL GAMES

BACKGROUND OF THE INVENTION

The invention relates to a string portion or a string of substantially uniform diameter for stringing a racket for ball games, in particular a tennis racket.

Ball rackets, in particular tennis rackets, are strung with strings in order to provide a resilient striking surface from which a ball impacting thereon can fly off. A simple test demonstrates that the bell rebounds from such a surface higher or faster than from a rigid surface, for example a concrete wall or the like. Even if the striking surface of a ball racket may be of all possible geometrical shapes, nonetheless the predominant proportion of commercially available ball rackets are of a more or less oval striking surface shape; that configuration has proven itself to be the best, over the centuries.

If the ball hits approximately the middle of the oval, or even hits the string bed somewhat more towards the handle, the ball is accelerated back; the ball has hit the so-called "sweet spot", that is to say the best possible acceleration surface on the racket.

The string portions used for conventional stringing arrangements, comprising longitudinal and transverse strings or diagonal strings, are of uniform thickness or are of invariable cross-section. In addition, they are of one material or the same material composition throughout and they are of the same nature within the string. That means that their resiliency characteristics, assuming the same force acting thereon, are the same in every part of the string.

In consideration of those facts, the inventor set himself the aim of enlarging the sweet spot of the striking surface and thus providing ideal stringing against which the ball does not absolutely have to impinge at the middle thereof in order to enjoy optimum acceleration. In spite of a very high level of skill on the part of a player, the certainty of hitting the ball at the middle of the racket is not always possible. The invention also seeks to provide generally improved hitting characteristics of the racket.

Further objects and advantages of the present invention will appear below.

SUMMARY OF THE INVENTION

The said objects are attained by the teaching of the present invention.

In accordance with the invention, the string portion is purposely to comprise different moduli of elasticity; in that way the sweet spot can be increased in size, reduced in size, or shifted, or a plurality of such spots can be simultaneously provided on the striking surface. With such a string according to the invention, it would be possible to attribute a degree of stretch which is established beforehand, to the string lengths which differ from one hole to another in the frame; the string would have a different modulus of elasticity in each part thereof.

DETAILED DESCRIPTION OF THE PREFERRED EMBODIMENTS

In order to achieve the best results, it would be advantageous for both string portions, for example the string portion for the longitudinal string and the string portion for the transverse string, to supplement each other, in other words, they would both purposely have to have different moduli of elasticity within the string. However even only one string of the configuration according to the invention would already afford measurable results.

Thus, in accordance with the invent ion the modulus of elasticity of the string portion or the string differs in a portion-wise manner, that is to say, the modulus of elasticity alters, with the same force acting in relation to the string cross-section, deliberately in accordance with predetermined factors in a section-wise manner abruptly or gradually within the length of the string portion, one or more times, in one or in both directions.

In an embodiment there is a step-wise change in the modulus of elasticity along the length of the string, but in another embodiment there is a stepless variation.

As mentioned, the string portion or the string, in accordance with the invention, may have a modulus of elasticity which rises in one direction, or a modulus of elasticity whose value changes along the length of the string at least twice and preferably several times.

In accordance with a further feature of the invention there is to be at least once a ratio of over 1.25 between the highest and lowest values in respect of the modulus of elasticity.

A string portion with different elasticity characteristics within the respective string length, of about 2 meters to 14 meters can be produced in different ways. In the region in which the string is to be less elastic, it is possible to add materials of lower elasticity, for example in the form of fibers, in the form of a pure material admixture or as a sheathing or cladding, which could also be effected for example by suitable vapor deposition. It will be appreciated that the same also applies in the opposite sense: more elastic materials could occur in place of the original material in the string portion.

It is also possible to envisage strings whose materials vary within the string. It is also possible to provide for a chemical treatment of the string at the intended locations, which could give rise to a lower or higher degree of elasticity at the treated locations.

The advantages of such strings with deliberately different elasticity within a string portion, which does not necessarily have to extend in terms of its length for example in respect of all longitudinal strings are apparent. It is possible to achieve deliberate control (increase or reduction in size or displacement) of the sweet spot by virtue of such strings on the striking surface of a ball racket. The sweet spot could be adapted in optimum fashion to the way in which a player plays, by virtue of suitable string portions.

By virtue of those conditions, the sweet spot can now be increased in size, in accordance with the stated object, However the reverse possibility could also be advantageous for many players, namely a reduction in the size of the sweet spot, In that case precisely the one location on the racket would generate a particularly high degree of acceleration which is thought to be higher than that which would be achieved with a larger sweet spot.

Depending on the nature of the string portion the invention affords possible solutions in regard to both situations, However even different modes of performance of the striking surface (it is possible for example to think of two sweet spots on the surface of the racket) can be produced with the string when of a suitable design.

What is claimed is:

1. A string for stringing a racket for ball games comprising a string of uniform diameter having a length and width, wherein the modulus of elasticity of the string is different in a portion-wise manner along the length of the string, including at least one of said strings disposed in a tennis racket wherein said tennis racket includes longitudinal and transverse strings, and wherein at least one of the longitudinal strings has a different modulus of elasticity than at least one of the transverse strings.

2. A string according to claim 1 including an abrupt change in the modulus of elasticity along the length of the string.

3. A string according to claim 1 including a gradual variation in the modulus of elasticity along the length of the string.

4. A string according to claim 1 wherein the modulus of elasticity rises in one direction of the string length.

5. A string according to claim 1 wherein the value of the modulus of elasticity changes at least twice along the length of the string.

6. A string according to claim 1 wherein there is a ratio of over 1.25 between the highest and lowest values of the modulus of elasticity at least once in said string.

7. A string according to claim 1 having a length of at least 2,000 mm.

8. A string according to claim 1 having a length of at most 14,000 mm.

9. A string according to claim 1 wherein the string length includes different portions thereof and wherein the modulus of elasticity varies from one portion of the string to another portion of the string.

* * * * *